US005413869A

United States Patent [19]

Hartzell et al.

[11] Patent Number: 5,413,869

[45] Date of Patent: * May 9, 1995

[54] CEMENTED CARBIDE BODY WITH INCREASED WEAR RESISTANCE

[75] Inventors: E. Torbjorn Hartzell, Stockholm; Udo K. Fischer, Vallingby; Jan Akerman, Stockholm, all of Sweden

[73] Assignee: Sandvik AB, Sandviken, Sweden

[ * ] Notice: The portion of the term of this patent subsequent to Apr. 4, 2012 has been disclaimed.

[21] Appl. No.: 976,381

[22] Filed: Nov. 13, 1992

[30] Foreign Application Priority Data

Nov. 13, 1991 [SE] Sweden ..... 9103344

[51] Int. Cl.[6] ..... B32B 15/04

[52] U.S. Cl. ..... 428/469; 51/307; 51/309; 428/472; 428/698; 428/699

[58] Field of Search ..... 428/698, 699, 472, 469; 51/307, 309

[56] References Cited

U.S. PATENT DOCUMENTS

| | | | |
|---|---|---|---|
| 2,842,342 | 7/1958 | Haglund . | |
| 4,705,124 | 11/1987 | Abrahamson et al. | 175/410 |
| 4,743,515 | 5/1988 | Fischer et al. | 428/695 |
| 4,820,482 | 4/1989 | Fischer et al. | 419/15 |
| 4,854,405 | 8/1989 | Stroud | 175/374 |
| 4,997,049 | 3/1991 | Tank et al. | 175/410 |
| 5,007,207 | 4/1991 | Phaal | 51/204 |
| 5,154,245 | 10/1992 | Waldenström et al. | 175/420.2 |

FOREIGN PATENT DOCUMENTS

| | | |
|---|---|---|
| 0438916 | 7/1991 | European Pat. Off. . |
| 0462955 | 12/1991 | European Pat. Off. . |
| 0498781 | 8/1992 | European Pat. Off. . |

*Primary Examiner*—A. A. Turner

*Attorney, Agent, or Firm*—Burns, Doane, Swecker & Mathis

[57] ABSTRACT

A cemented carbide button for rock drilling comprises a core and a surface zone surrounding the core whereby both the surface zone and the core contains WC (alpha-phase) and a binder phase based on at least one of Co, Ni, or Fe and the core in addition contains eta-phase. The eta-phase core extends to the very top (working) surface of the button and as a result is obtained longer life and higher drilling rate particularly for rotating crushing drilling, cutting drilling and percussive drilling in soft rocks.

4 Claims, 1 Drawing Sheet

CEMENTED CARBIDE BODY WITH INCREASED WEAR RESISTANCE

BACKGROUND OF THE INVENTION

The present invention relates to cemented carbide buttons useful in tools for rock drilling, mineral cutting, oil drilling and in tools for concrete and asphalt milling.

In U.S. Pat. No. 4,743,515, cemented carbide buttons are disclosed with a core of finely and evenly distributed eta-phase embedded in the normal alpha+beta-phase structure, and a surrounding surface zone of only alpha+beta-phase. (alpha=tungsten carbide, beta=-metal binder, e.g., Co, and eta=$M_6C$, $M_{12}C$ and other carbides, e.g., $Co_3W_3C$). In the inner part of the surface zone situated close to the core of that body, the Co-content is higher than the nominal content of Co. The Co-content in the outermost part of the surface zone is lower than the nominal and increases in the direction towards the core up to a maximum usually at the eta-phase core.

Cemented carbide buttons according to the mentioned patent have given increased performance for all cemented carbide grades normally used in rock drilling.

When drilling with buttons according to the above-mentioned patent, the Co-poor surface layer is successively worn away. The Co-rich intermediate layer, when exposed, is worn more rapidly than the surrounding areas and a crater is formed (FIG. 1.3). As a result, the risk for spalling is increased and at the same time the drilling rate is decreased. At continued wear, the eta-phase core is exposed and the button then assumes a more rounded cap shape, FIG. 1.5. The wearing through of the Co-rich intermediate zone is particularly critical in rotary crushing drilling with chisel shaped or conical buttons which are not reground. In order to avoid too deep a crater in the button, the thickness of the eta-phase free surface zone is kept to a minimum. The risk is then that the Co-poor surface zone peels off and exposes the Co-rich part with a resulting rapid wear. The button thereby quickly loses several mm in protrusion height. The protrusion and shape of the button influence the drilling properties, in particular the penetration rate.

OBJECTS AND SUMMARY OF THE INVENTION

It is an object of this invention to avoid or alleviate the problems of the prior art.

It is further an object of this invention to provide an improved cemented carbide body with increased wear resistance.

In one aspect of the invention there is provided a cemented carbide button for rock drilling comprising a core and a surface and zone surrounding the core whereby both the surface zone and the core contain WC and a binder phase based on at least one of Co, Ni or Fe and that the core in addition, contains eta-phase wherein the eta-phase core extends to the very top surface of the button.

In another aspect of the invention there is provided a method of manufacturing a cemented carbide button for rock drilling by powder metallurgical methods such as milling, pressing and sintering whereby a powder with substoichiometric content of carbon is sintered to an eta-phase-containing body which after the sintering is given a partially carburizing heat treatment whereby an eta-phase-containing core surrounded by an eta-phase-free surface zone is obtained wherein the top surface of the body is protected from carburization.

In yet another aspect of the invention there is provided a method of rock drilling at which a cemented carbide button comprising a core and a surface zone surrounding the core, whereby both the surface zone and the core contains WC and a binder phase based on at least one of Co, Ni or Fe and that the core in addition, contains eta-phase, is brought in contact with rock and the button moves relative to the rock whereby material is removed from the rock wherein the eta-phase core already from the beginning of the drilling is in contact with the rock.

BRIEF DESCRIPTION OF THE DRAWINGS

The invention is described with reference to the following figures in which a is eta-phase core, b is Co-rich zone and c is Co-poor zone.

FIG. 1 shows a button made according to known techniques, in which:

FIG. 1.1 is an unworn button;

FIG. 1.2 depicts wear only in the Co-poor eta-phase free surface zone;

FIG. 1.3 depicts wear through the Co-rich intermediate zone;

FIG. 1.4 depicts continued wear—the button has changed shape;

FIG. 1.5 depicts the eta-phase core being clearly exposed.

FIG. 2.1 is a conical button with a symmetrical eta-phase core;

FIG. 2.2 is a spherical button with an asymmetrical eta-phase core;

FIG. 2.3 is a chisel-shaped button with a symmetrical eta-phase core.

DETAILED DESCRIPTION OF THE PREFERRED EMBODIMENTS OF THE INVENTION

Figure 1:
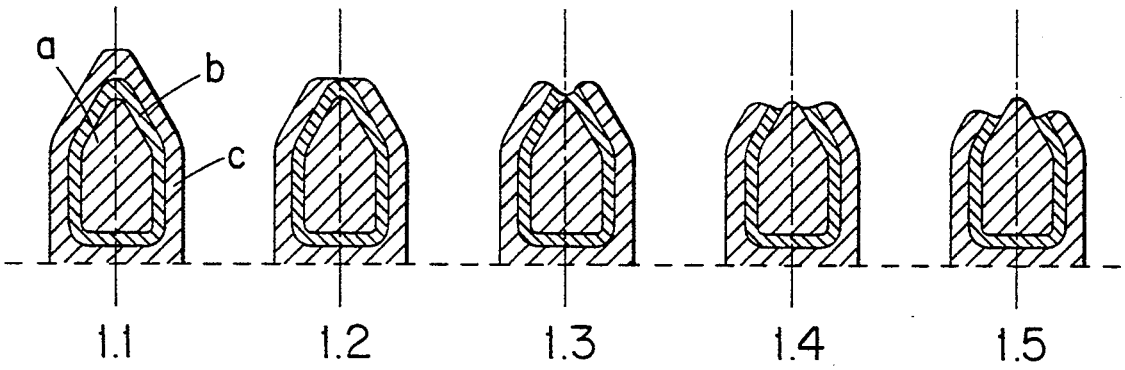
FIG. 1 (PRIOR ART)

According to the invention it has now turned out that buttons where the eta-phase core extends out to the very top surface of the button give longer life and increased drilling rate, particularly in rotary crushing drilling, percussive drilling in soft rocks and in mineral cutting. The eta-phase core is not crushed due to that it is protected by the surface zone free of eta-phase, whose outer part is under compressive stress.

The eta-phase core contains at least 2% by volume, preferably at least 5% by volume, of eta-phase, but at most 60% by volume, preferably at most 35% by volume. The eta-phase shall be fine-grained with a grain size of 0.5–10 $\mu$m, preferably 1–5 $\mu$m, and be evenly distributed in the matrix of the normal WC-Co-structure. The width of the eta-phase core shall be 10–95%, preferably 25–75%, of the cross-section of the cemented carbide body. The eta-phase core extends to the very top (working) surface of the button. Normally, the position of the core within the button is symmetrical but for certain locations of the button in a drill, e.g., for use as a peripheral button, the core may suitably be in an asymmetrical position in the button.

The binder phase content in the zone free of eta-phase increases in the direction toward the eta-phase core up to a maximum usually at the eta-phase core of at least 1.2 times, preferably at least 1.4 times, compared to the binder phase content in the center of the eta-phase core.

In addition, the top surface of the button may have a thin surface layer 10–100 μm thick free of eta-phase.

The invention can particularly be used in grades with 10–25% by weight Co for rotary crushing drilling, but also in grades with 5–10% by weight Co for percussive drilling in softer rocks and in grades with 6–13% be weight Co for mineral tools. The WC-grain size can vary from 1.0 μm up to 10 μm, preferably 2–8 μm.

The Co-portion in the eta-phase can completely or partly be replaced by one of the metals Fe or Ni, i.e., the eta-phase itself can contain one or more of the iron group metals in combination.

Up to 15% by weight of tungsten in the alpha-phase can be replaced by one or more of the metallic carbide formers Ti, Zr, Hf, V, Nb, Ta, Cr and Mo.

Cemented carbide bodies according to the invention are manufactured according to powder metallurgical methods: milling, pressing and sintering. By starting from a powder with substoichiometric composition with respect to carbon, an eta-phase-containing cemented carbide button is obtained during the sintering. The sintered button is then given a carburizing heat treatment in accordance with the disclosure of U.S. Pat. No. 4,743,515 with the top (or working) surface of the button being protected from carburization by a thin reaction-protective layer of, e.g., $Al_2O_3$. In this fashion, the protected portion remains as the eta-phase-containing material of the core.

The invention also relates to a method of rock drilling at which a cemented carbide button is brought in contact with rock and the button moves relative to the rock whereby material is removed from the rock. According to the invention, the eta-phase core is already from the beginning of the drilling in contact with the rock.

The invention is additionally illustrated in connection with the following Examples which are to be considered as illustrative of the present invention. It should be understood, however, that the invention is not limited to the specific details of the Examples.

EXAMPLE 1

Buttons with a conical top were pressed using a WC-10 weight % Co powder with a 0.2% by weight substoichiometric carbon content (5.3% by weight C instead of 5.5% by weight). These were sintered at 1450° C. under standard conditions. After sintering, the diameter of the buttons was 14 mm. The top surface of the button was covered by a CVD-layer of $Al_2O_3$. The buttons were then heat treated in a furnace containing a $CO/H_2$ carburizing atmosphere at 1400° C. for 4 hours.

Figure 2:
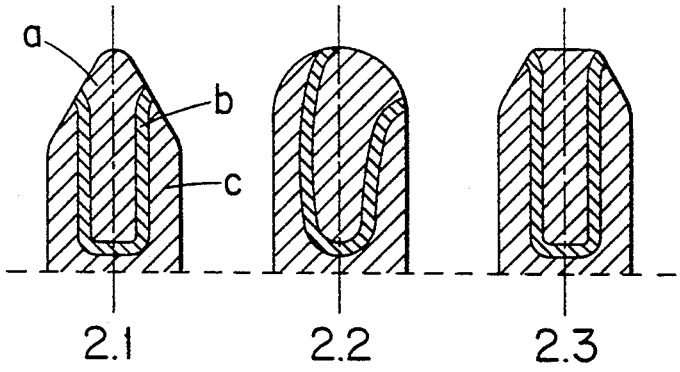
FIG. 2 shows buttons according to the invention in various embodiments, namely.

The buttons manufactured in this way comprised a 4 mm wide surface zone free of eta-phase and a core with a diameter of 6 mm containing finely dispersed eta-phase. The core extended to the top surface of the button, as shown in FIG. 2.1. The Co-content at the surface of the cylindrical part was measured to be 5% by weight and just outside the eta-phase core 16% by weight.

EXAMPLE 2

Buttons with a chisel-shaped top were pressed using a WC-15 weight % Co powder with a 0.4% by weight substoichiometric carbon content (4.8% C instead of 5.2%). The buttons were sintered at 1410° C. under standard conditions. After sintering, the diameter of the buttons was 12 mm. The buttons were covered by a thin layer of graphite-slurry except from the top surface which was coated with a thin layer of $Al_2O_3$ slurry and then heat treated in a furnace containing $H_2$ atmosphere at 1400° C. for 2 hours.

The buttons manufactured in this way comprised a 3 mm wide surface zone free of eta-phase and a core with a diameter of 6 mm containing finely dispersed eta-phase. The core extended to the top surface of the button as shown in FIG. 2.3. The Co-content at the surface of the cylindrical part of the button was measured to be 7% and just outside the eta-phase core 25%.

EXAMPLE 3

Drilling in an open pit mine with roller bits.
Machine: Bucyrus Erie 45R
Feeding pressure: 30 tons
Rotation: 60–85 rpm
Hole depth: 20 m
Bit: 9 7/8" CS 3
Rock: Biotite gneiss-mica slate
Variant 1: Buttons according to Example 1.
Variant 2: Buttons according to U.S. Pat. No. 4,743,515 with an average Co-content of 10%

Result:

| Variant | Life Length m | Index | Rate of Penetration m/h | Index |
|---|---|---|---|---|
| 1 | 1210 | 106 | 18 | 139 |
| 2 | 1145 | 100 | 13 | 100 |

The bit according to the invention has reached longer life, but above all, a higher penetration rate.

EXAMPLE 4

In raise boring, rolls equipped with cemented carbide buttons are used. The buttons have a chisel-shaped top and the rolls are scrapped when the buttons are worn flat.

On a raise-head (diameter 2.5 m) a roll with cemented carbide buttons (diameter 22 mm) according to the invention was tested. A test-roll with standard buttons was placed diametrically to the former roll.

Rig: Robbins 71R
Drilled shaft: 155 m
Rate of Penetration: 0.9 m/h
Variant 1: Buttons according to the invention with a diameter of 22 mm and a surface zone free of eta-phase of 5 mm. The Co-content close to the outer surface of the button was 8% and in the Co-rich part of the surface zone it was 22%. The nominal Co-content was 15%.
Variant 2: Standard buttons with a Co-content of 15%.
Variant 3: Buttons according to U.S. Pat. No. 4,743,515 with an average Co-content of 20%. The thickness of the eta-phase-free surface zone was 4 mm.

Result:

The remaining button protrusion for variant 1 was 6 mm and for variant 2 was 3.5 mm. The buttons according to variant 2 had in addition, a more rounded top. The surface zone free of eta-phase of the buttons according to variant 3 was spalled in an early stage and the remaining button protrusion was 3 mm.

EXAMPLE 5

Test with oil drill bits on an "on-shore rig."

The bits were tested in an area with abrasive formations containing sandstone and limestone.

Bit dimension: 7 7/8"

Type of buttons: Chisel-shaped

Variant 1: In row 1, buttons according to the invention with a nominal Co-content of 8%. In the other rows, buttons according to U.S. Pat. No. 4,743,515 with a nominal Co-content of 15%.

Variant 2: In row 1, buttons according to U.S. Pat. No. 4,743,515 with a nominal Co-content of 8%. In other rows, buttons according to U.S. Pat. No. 4,743,515 with a nominal Co-content of 15%.

Variant 3: Standard buttons with a Co-content of 8% in row 1 and 15% in the other rows.

Result:

| Variant | Number | Drilled Meters | Index | Rate of Penetration m/h | Index |
|---|---|---|---|---|---|
| 1 | 3 | 485 | 178 | 8.3 | 184 |
| 2 | 3 | 389 | 143 | 6.4 | 142 |
| 3 | 5 | 273 | 100 | 4.5 | 100 |

The distinctly better result of variant 1 is a consequence of the increased wear resistance thus leading to a maintained chisel-shaped top of the buttons in row 1.

EXAMPLE 6

Trenching in tarmac road for laying gas pipe line.

Machine: Rivard 120. 12-ton band tractor with one trenching wheel, diameter 2 m, equipped with totally 80 cutting tools.

Wheel width: 0.25 m

Rotation speed of the tool: 10 m/s

Trench depth: 1 m

Tool positioning: The standard and the test variants were placed in such a way that a fair judgement of properties could be made.

Type of button: Diameter 18 mm with a conical top and a length of 30 mm, brazed into standard tools.

Variant 1: Cemented carbide according to the invention. A nominal Co-content of 11%, the same zone distribution as in variant 2, but the eta-phase reached the top surface of the button.

Variant 2: Cemented carbide according to U.S. Pat. No. 4,743,515. Nominal Co-content 11%, the surface zone free of eta-phase was 5 mm in which the Co-poor part was 3 mm and the Co-rich part was 2 mm.

Variant 3: Standard cemented carbide with 11% Co and the WC-grain size 4 μm.

About 100 $m^3$ road was cut, the asphalt was 0.1 m thick, the intermediate layer containing bricks, sand and limestone was 0.3 m thick and the ground below contained sand, pebbles and some parts of limestone.

Result:

| Variant | Height Wear mm | Index | Failures | Number of Tools |
|---|---|---|---|---|
| 1 | 4.2 | 250 | 0 | 20 |
| 2 | 5.4 | 182 | 3 | 20 |
| 3 | 9 | 100 | 4 | 40 |

EXAMPLE 7

Drifting in a limestone mine with drill bits, diameter 55 mm, equipped with buttons, diameter 11 mm.

Drilling Machine: COP 1038 HB

Feeding Pressure: 60 bar

Rotation Pressure: 60 bar

Hole Depth: 4.4 m

Variant 1: Buttons according to the invention. Nominal Co-content 6%. The diameter of the eta-phase core was 6 mm and the core reached the top surface of the button. The button had a conical top.

Variant 2: Buttons according to U.S. Pat. No. 4,743,515 with the same size of the eta-phase core as in variant 1. Nominal Co-content 6% and a conical top.

Variant 3: Standard buttons with 6% Co and a spherical top.

Result:

| Variant | Life Length m | Index | Rate of Penetration m/min | Index |
|---|---|---|---|---|
| 1 | 1685 | 131 | 2.3 | 153 |
| 2 | 1320 | 116 | 1.9 | 127 |
| 3 | 1142 | 100 | 1.5 | 100 |

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. A cemented carbide button for rock drilling having a working surface and which button comprises a core and a surface zone surrounding the core whereby both the surface zone and the core contain WC and a binder phase based on at least one of Co, Ni or Fe, the surface zone being free of eta-phase and the core containing eta-phase, the eta-phase core extending to the working surface of the button from the time the button first contacts the rock said eta phase core providing increased wear resistance without crater formation.

2. The cemented carbide button of claim 1 wherein the eta-phase core is asymmetrically located in the button.

3. The cemented carbide button of claim 1 wherein the binder phase content in the zone free of eta-phase increases in the direction towards the eta-phase core up to a maximum of at least 1.2 times the binder phase content in the center of the eta-phase core.

4. The cemented carbide button of claim 3 wherein the binder phase content in the zone free of eta-phase increases in the direction towards the eta-phase core up to a maximum of at least 1.4 times the binder phase content in the center of the eta-phase core.

* * * * *